United States Patent [19]

Ogles

[11] 4,381,695

[45] May 3, 1983

[54] HYDRAULICALLY OPERATED PUMP JACK WITH HOLDING VALVES AND CONTROL ASSEMBLY

[75] Inventor: Ethridge F. Ogles, Ada, Okla.

[73] Assignee: Wink H. Kopcynski, Ada, Okla.

[21] Appl. No.: 174,589

[22] Filed: Aug. 1, 1980

[51] Int. Cl.[3] ..... F01L 31/00; F01L 15/00

[52] U.S. Cl. ..... 91/178; 91/350; 91/351; 91/447; 60/369; 74/519

[58] Field of Search ..... 74/519, 522; 60/369; 74/589, 590, 41; 91/218, 176, 178, 351, 350, 353, 354, 536, 530, 447

[56] References Cited

U.S. PATENT DOCUMENTS

| | | | |
|---|---|---|---|
| 2,432,735 | 12/1947 | Downing | 74/589 |
| 3,128,675 | 4/1964 | Dulaney | 91/176 |
| 3,971,213 | 7/1976 | Kelley | 74/589 |
| 4,007,845 | 2/1977 | Worback | 91/420 |

*Primary Examiner*—Paul E. Maslousky
*Attorney, Agent, or Firm*—Harvey B. Jacobson

[57] ABSTRACT

A hydraulically operated pump jack utilizing dual hydraulically operated piston and cylinder assemblies for pivoting the beam of the pump jack and including a unique control arrangement associated with a reversing valve for controlling operation of the piston and cylinder assemblies. The control arrangement includes a hydraulically operated holding valve incorporated into each of the conduits between the reversing valve and the hydraulically operated piston and cylinder assemblies combined with a control piston and cylinder assembly for controlling the operation of the holding valves. A manually operated valve assembly is also incorporated into each conduit to enable conversion of either or both of the piston and cylinder assemblies from double acting to single acting. The control arrangement also includes a unique mechanism for operating the reversing valve automatically with this mechansim including a structure enabling manual disengagement of the automatic operating mechanism for the reversing valve with the reversing valve being capable of manual operation after such disengagement.

14 Claims, 15 Drawing Figures

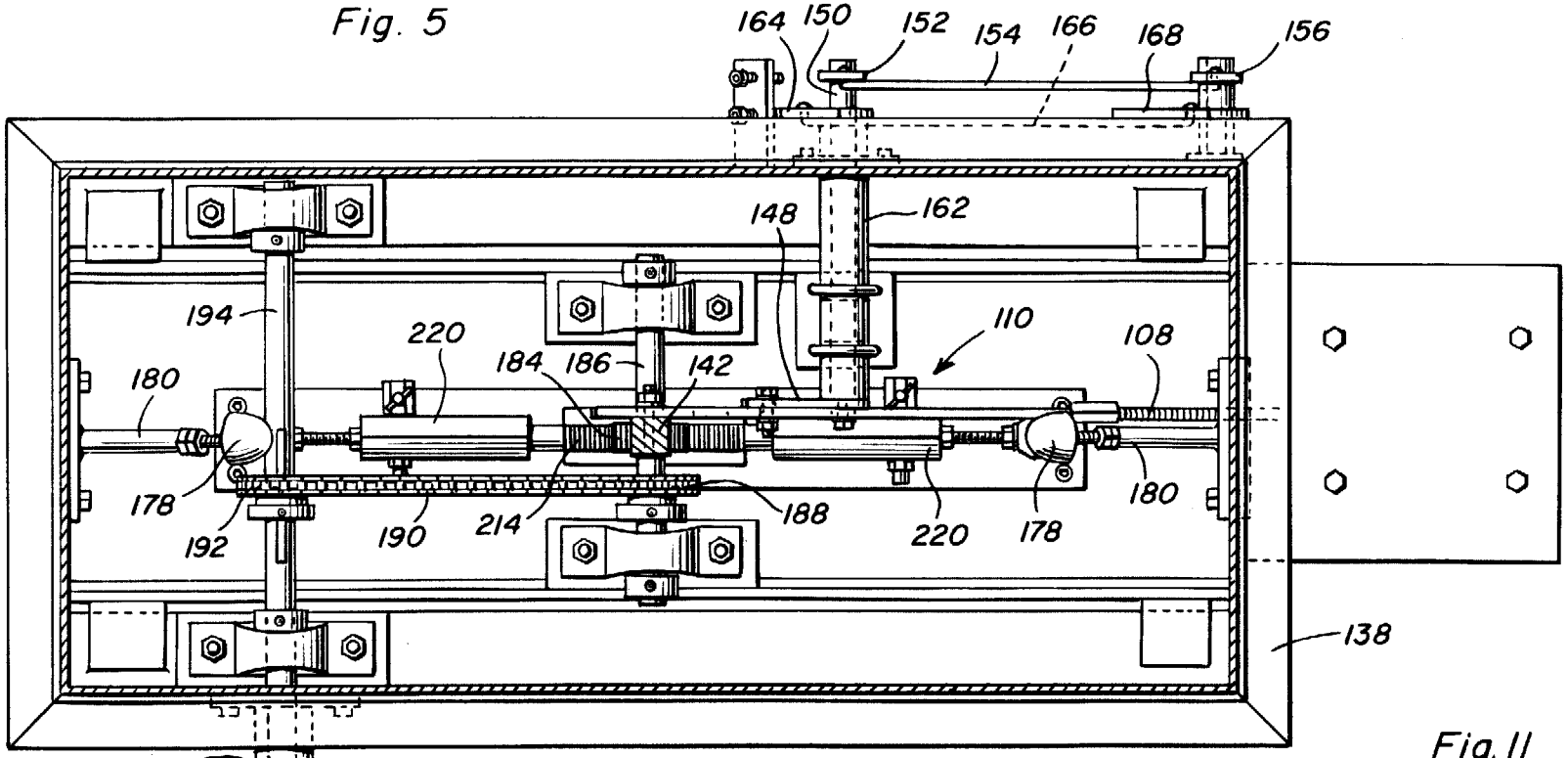
Fig. 5
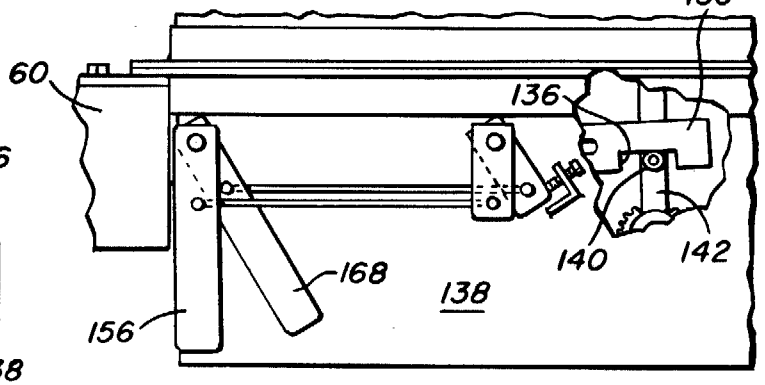
Fig. 11
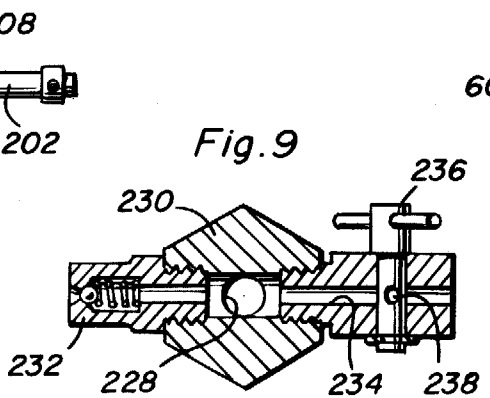
Fig. 9
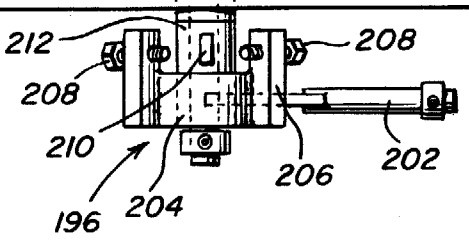

HYDRAULICALLY OPERATED PUMP JACK WITH HOLDING VALVES AND CONTROL ASSEMBLY

BACKGROUND OF THE INVENTION

1. Field of the Invention

The present invention generally relates to a pump jack utilizing dual hydraulically operated piston and cylinder assemblies for oscillating the beam about a generally horizontal axis with a control arrangement which positively controls movement of the beam throughout its cycle of operation with the control arrangement including an automatically operated reversing valve operatively associated with the beam and capable of being disengaged from operation by the beam to enable manual operation of the reversing valve together with a hydraulically operated holding valve in each of the hydraulic conduits between the reversing valve and piston and cylinder assembly with each holding valve being controlled from a piston and cylinder assembly interconnecting the conduits so that the hydraulic fluid which operates the dual piston and cylinder assemblies is under positive control thereby providing positive control of the beam throughout its oscillating cycle.

2. Description of the Prior Art

My prior U.S. Pat. Nos. 4,099,447, issued July 11, 1978 and 4,201,115, issued May 6, 1980 disclose hydraulically operated oil well pump jacks with an automatic reversing valve and a cushioning arrangement for cushioning movement of the beam. The reference cited in the above two patents represents some of the prior art.

In addition, the following U.S. patents relate to pump jacks and operating mechanisms therefor:

U.S. Pat. No. 2,169,815—Patterson
U.S. Pat. No. 2,432,735—Downing
U.S. Pat. No. 2,915,919—Mitchell
U.S. Pat. No. 3,264,942—Witt Of the above listed patents, the Downing patent is probably the most relevant since it discloses a double acting hydraulically operated piston and cylinder assembly for oscillating the walking beam of a pump jack with an automatically operated reversing valve controlling operation of the pump jack.

SUMMARY OF THE INVENTION

An object of the present invention is to provide a pump jack for oil wells or other fluid producing wells utilizing hydraulic piston and cylinder assemblies for oscillating the beam with the piston and cylinder assemblies being controlled by a reversing valve and a unique control apparatus to maintain positive control of the beam throughout its cycle of movement.

Another object of the invention is to provide a pump jack in accordance with the preceeding object in which the control arrangement includes a holding valve in each of the hydraulic conduits extending from the reversing valve to the piston and cylinder assemblies with each holding valve being hydraulically operated and controlled by a piston and cylinder assembly interconnecting the hydraulic conduits between the reversing valve and the holding valves so that the holding valve in the hydraulic flow line returning to the reversing valve will be retained in closed position until fluid flow occurs in the hydraulic line between the reversing valve and the other hydraulic cylinder and piston assemblies so that the holding valves are automatically controlled in response to fluid flow from the reversing valve to the respective piston and cylinder assemblies.

A further object of the invention is to provide a pump jack and control arrangement as set forth in the preceding objects in which each hydraulic conduit is provided with a manual valve between the holding valve and the respective piston and cylinder assemblies to enable either or both of the piston and cylinder assemblies to be converted from double acting to single acting to provide for fast return when desired.

Yet another object of the invention is to provide a pump jack and control arrangement as set forth in the preceding objects together with a control arrangement for the reversing valve operative in response to oscillation of the beam and including a manual structure to enable disengagement of the automatic control and enable manual movement of the reversing valve for manually controlling the beam when desired.

Yet another important object of the invention is to provide a reversing valve with automatic control including an oscillatable weight of unique construction and a piston and cylinder assembly controlling movement of the oscillating weight thereby providing automatic control for the position of the reversing valve in response to oscillation of the beam.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a horizontal plan sectional view of the control arrangement illustrated in FIG. 4.

FIG. 9 is a detailed sectional view taken substantially upon a plane passing along section line 9—9 of FIG. 6 illustrating further details of the control assembly for the reversing valve.

FIG. 11 is a fragmental elevational view illustrating the manually operated mechanism for disengaging the reversing valve from its automatic control and providing manual control for the reversing valve.

DESCRIPTION OF THE PREFERRED EMBODIMENTS

Figure 1:
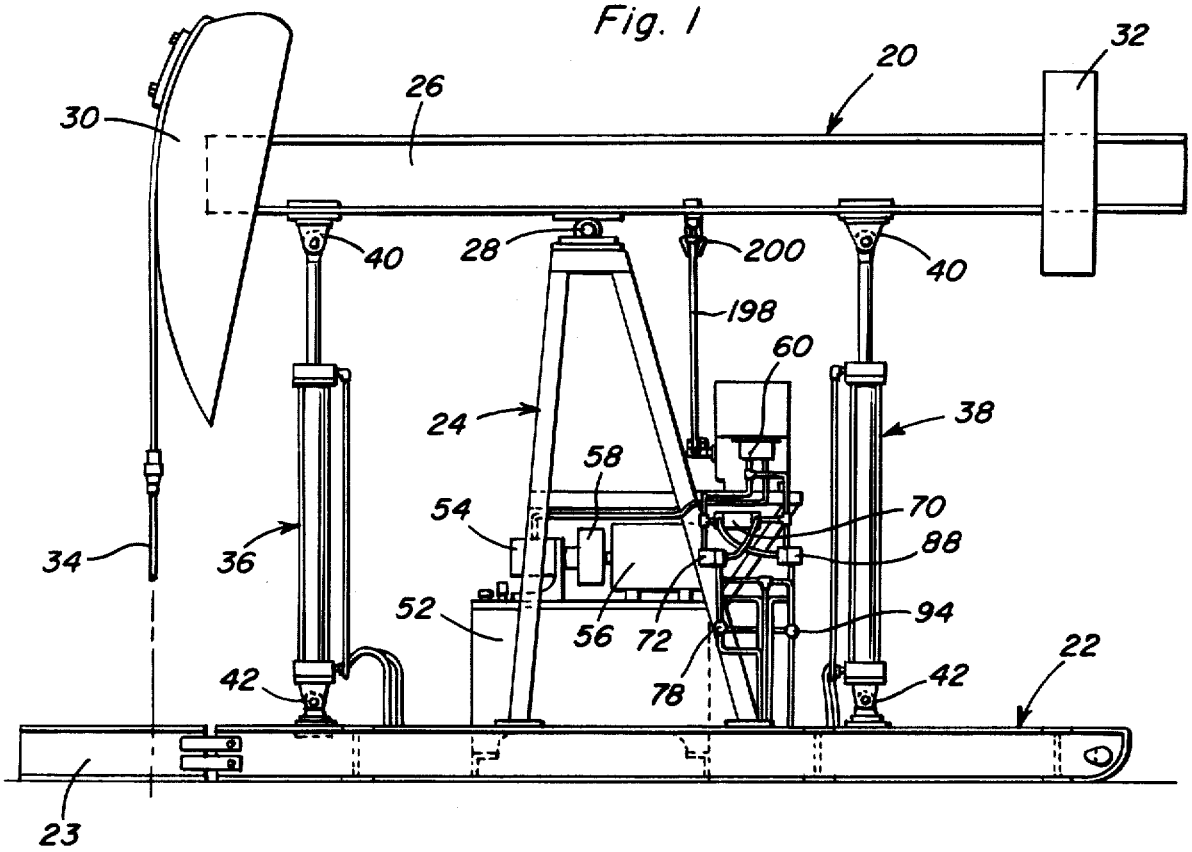
FIG. 1 is a side elevational view of the pump jack of the present invention illustrating the association of the components.
Figure 2:
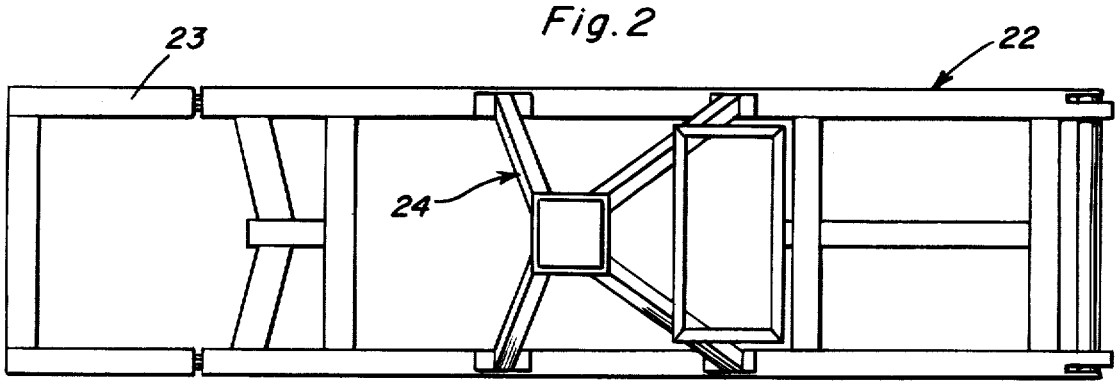
FIG. 2 is a top plan view of the supporting base for the components of the present invention.

Referring now specifically to the drawings, the pump jack of the present invention is generally designated by numeral 10 and includes a rigid supporting base or skid generally designated by numeral 22 and a rigid upstanding supporting framework or samson post 24 supporting an elongated beam 26 at its upper end for pivotal movement about a horizontal axis by a saddle bearing assembly 28. One end of the beam 26 is provided with a horse head 30 and the other end thereof is provided with a counterweight 32 which may be longitudinally adjustable in a known manner. The horse head 30 is adapted to be connected to a polish rod 34 of an oil well pump through a suitable bridle or the like (not shown). The aforedescribed structure is conventional in and of itself and is disclosed herein to illustrate the specific unique features of the present invention.

Interconnecting the base 22 and the beam 26 is a pair of double acting hydraulic piston and cylinder assemblies 36 and 38 which are pivotally connected to the beam 26 by a pivot bracket 40 connected with the piston rod and the beam 26. The lower end of the piston and cylinder assemblies 36 and 38 are connected to the base 22 by a pivot bracket 42. The points of connection between the piston and cylinder assemblies 36 and 38 and the beam and the base may be varied depending upon the installation requirements for each well and the piston and cylinder assembly 36 is provided with a hydraulic conduit 44 communicating with the upper end thereof and a hydraulic conduit 46 communicating with the lower end thereof. Likewise, the piston and cylinder assembly 38 includes a conduit 48 communicating with the upper end thereof and a hydraulic conduit 50 communicating with the lower end thereof and each of the piston and cylinder assemblies 36 and 38 are double acting or can be converted to single acting in a manner described hereinafter. The specific details of the conduits, the connections with the piston and cylinder assemblies and the specific structure of the piston and cylinder assemblies themselves are not shown in detail with it being understood that standard structural arrangements may be utilized commensurate with the pressures and loads involved and the length of extension and retraction of the piston and cylinder assemblies required due to the installational requirements in the pump jack.

Centrally located on the base 22 is a tank or reservoir 52 for hydraulic fluid and mounted on top of the reservoir is a variable capacity vane type pump 54 driven by a suitable motor 56, such as an electric motor, or the like, and an oil cooler 58 may be provided for maintaining the hydraulic fluid within certain temperature parameters. The pump 54 supplies hydraulic fluid to a reversing valve 60 through supply line 61 and a return line 62 extends from the reversing valve back into the reservoir or tank 52. Suitable filters, strainers, pressure gauge, flow meters, and the like, may be incorporated into the hydraulic system and suitable means may be provided for adding hydraulic fluid to the system when required or removing fluid at any time desired to maintain a predetermined supply of hydraulic fluid for operation of the system.

Figure 3:
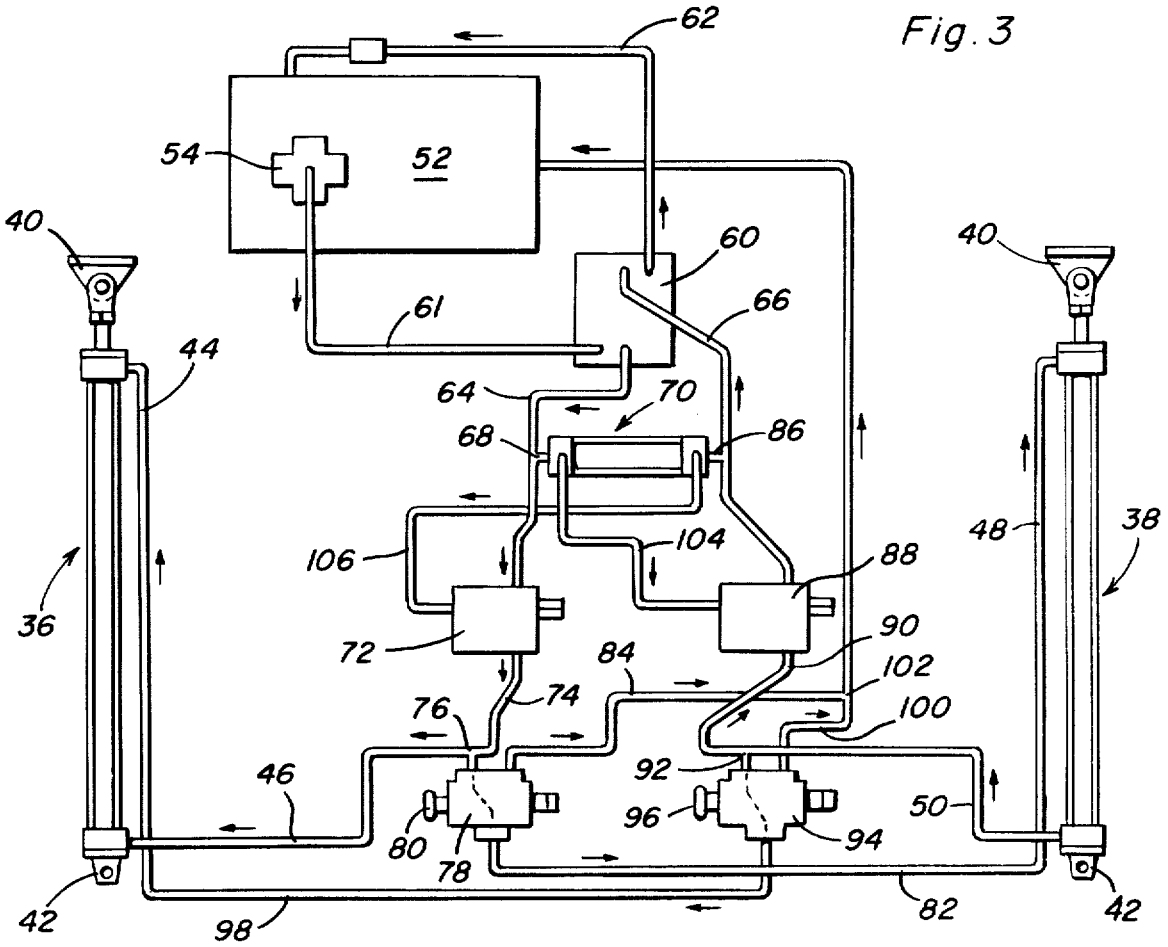
FIG. 3 is a schematic view illustrating the hydraulic control arrangements for the piston and cylinder assemblies.
Figure 8:
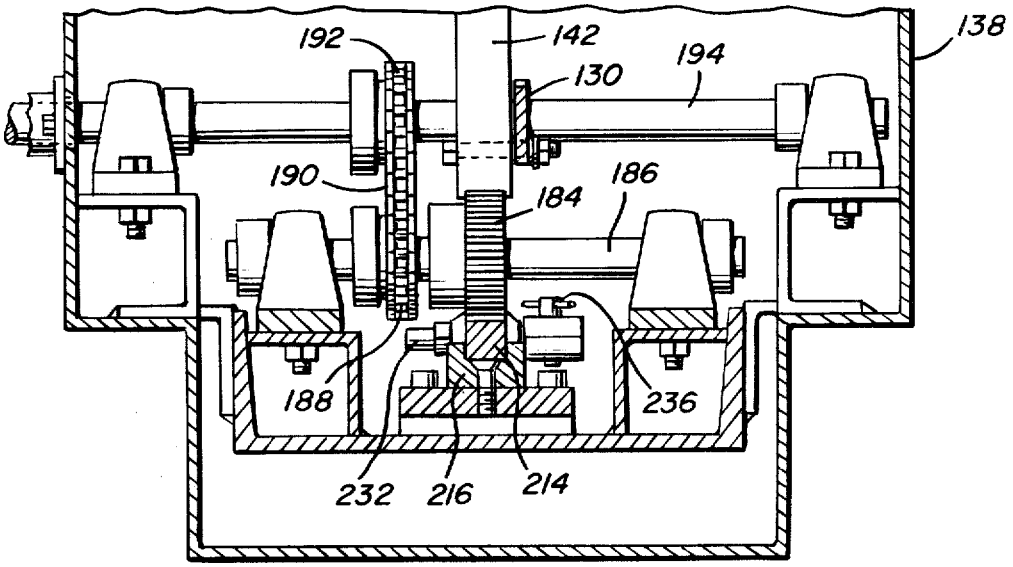
FIG. 8 is a transverse sectional view taken substantially upon a plane passing along section line 8—8 of FIG. 4 illustrating further structural details of the control arrangement.

Extending from the reversing valve 60 is a pair of hydraulic conduits 64 and 66. The conduit 64 includes a T-connection 68 with a control piston and cylinder assembly 70. The conduit 64 then extends into a hydraulically operated holding valve 72. from the holding valve 72, a conduit 74 extends therefrom and includes a T-connection 76 with a manual valve 78 having an operating handle 80 at one end thereof. The conduit 74 after it passes the T-connection 76 becomes the hydraulic conduit 46 communicating with the lower end of the piston and cylinder assembly 36 as illustrated in FIG. 3. The valve 76 also includes a discharge conduit 82 which becomes the conduit 48 communicating with the upper end of the piston and cylinder assembly 38 and a bypass or return conduit 84 which returns to the reservoir 52 as illustrated in FIG. 3.

The other conduit 66 includes a T-connection 86 with the opposite end of the control piston and cylinder assembly 70 and then enters a holding valve 88 which is hydraulically operated. From the holding valve 88, a conduit 90 communicates with a T-connection 92 and a manual valve 94 having a control handle 96 on one end thereof. The conduit 90 after it passes the T-connection 92 becomes the conduit 50 which communicates with the lower end of the piston and cylinder assembly 38. Also, the valve 94 includes a discharge conduit 98 which becomes the conduit 44 communicating with the upper end of the piston and cylinder assembly 36. The valve 94 also includes a bypass conduit 100 which includes a T-connection 102 with the conduit 84 which returns to the reservoir 52. The control piston and cylinder assembly 70 includes a control conduit 104 which interconnects the end of the control piston and cylinder 70 adjacent the conduit 64 with the holding valve 88 in the conduit 66 thereby hydraulically controlling the holding valve 88 in the conduit 66. Likewise, the opposite end of the control piston and cylinder 70, that is, the end adjacent the conduit 66, includes a conduit 106 extending therefrom and communicating with the holding valve 72 in the conduit 64 thereby hydraulically controlling the holding valve 72 in the conduit 64. The holding valves 72 and 88 are one-way valves which permit flow toward valves 78 and 94 but the return flow passages therein are normally closed and are opened when hydraulic fluid flow at a predetermined pressure flows through the respective conduits 104 and 106. The valves 72 and 88 are commercially available and conventional in construction. Exemplary check valves with an external opening device are found in class 251 subclass 82 with U.S. Pat. No. 3,334,858 issued Aug. 8, 1967 disclosing a swing type check valve that can be moved to an open position for reverse flow by an actuator which may be hydraulic. Additional patents disclosing similar structures are U.S. Pat. Nos. 2,504,006 issued Apr. 11, 1950 and 4,269,215, issued May 26, 1981. The specific structure of the one way valve or check valve which is opened hydraulically to enable reverse flow back through the one way valve or check valve forms no specific part of the invention per se but represents a component of the system to enable opening of the one way valve for reverse flow therethrough in response to hydraulic pressure.

The reversing valve 60 is controlled by an operating rod 108 extending from a control arrangement 110 for automatically operating the reversing valve for movement of the spindle thereof in a reciprocatory manner depending upon the oscillatory movement of the beam 26 with the control arrangement 110 being more specifically described hereinafter. When the reversing valve moves to a position to supply hydraulic fluid to the conduit 64, it also opens the return line 62 so that hydraulic fluid from the conduit 66 will return to the reservoir 52 through the conduit 62. In this condition, the holding valve 88 is closed and there is no pressure in the conduit 66 since it is in communication with the reservoir 52. Hydraulic fluid flow through the conduit 64 will pass through the holding valve 72 and through the conduit 74 into the conduit 46 into the lower end of the piston and cylinder assembly 36 and at the same time through the conduit 82 into the upper end of the piston and cylinder assembly 38 and as the piston and cylinder assembly 36 expands and the piston and cylinder assembly 38 retracts, the displaced fluid will attempt to return through conduit 50 to the holding valve 88 which is closed. However, valve 88 will be opened as soon as fluid flow occurs through the T-connection 68, control piston and cylinder assembly 70 and conduit 104 into the holding valve 88 for cracking open the holding valve 88 so that return flow to the reservoir 52 is controlled by the holding valve 88 which is operated by hydraulic fluid entering the holding valve 88 through the conduit 104. The holding valves 72 and 88 are, in effect, one-way valves in that fluid flow is permitted when pressure enters the holding valve from the reversing valve, but return flow through the holding valve toward the reversing valve is precluded with the return flow only being permitted when the holding valve is opened by hydraulic flow in the respective conduits 104 and 106. When the reversing valve 60 is reversed, the same conditions will occur, that is, fluid pressure can enter the piston and cylinder assemblies through one of the holding valves but the other valve will prevent return flow until it is opened by fluid flow in the control conduit. Under these circumstances, there is provided a control for the hydraulic fluid flow so that the movement of the beam is positively controlled throughout its cycle of operation.

Figure 12:
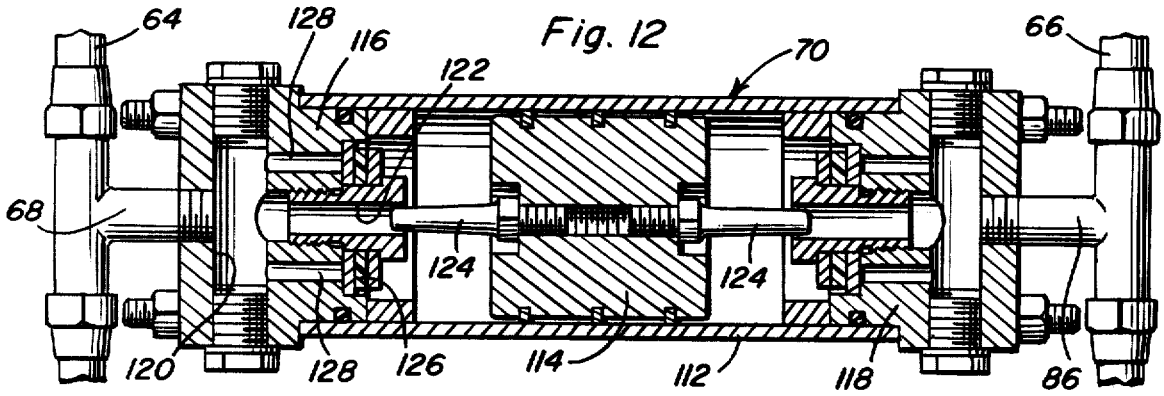
FIG. 12 is a longitudinal sectional view of the piston and cylinder assembly controlling the holding valves in the hydraulic conduits from the reversing valve to the piston and cylinder assemblies.

FIG. 12 illustrates the specific details of the piston and cylinder control arrangement 70 which includes a cylinder 112 having a piston 114 freely movable therein with each end of the cylinder being closed by a cylinder head or fitting 116 and 118, respectively, which are substantially duplicates of each other and with one of them being described in detail herein. The cylinder head 116 includes a passageway 120 communicating with the T-coupling 68 in the conduit 64 and communicating with the control conduit 104 extending to the holding valve 88 and also in communication with a passageway 122 extending into the space between the piston 114 and the adjacent cylinder head 116 as illustrated in FIG. 12. The piston 114 is provided with a tapered pin 124 on each end thereof which telescopes into the passageway 122 when the piston 114 approaches the passageway 122 so that it serves to restrict flow from the cylinder into the passageway 120 thereby slowing down and stopping the piston 114 as the tapered pin 124 enters the passageway 122 so that the oppositely projecting pins 124, in effect, provides a progressively restricted passageway as the tapering pin 124 telescopes into the passageway 122. In the reverse direction, relatively unrestricted flow occurs past flap valves 126 which form closures for passageways 128 outwardly of the central passageway 122 so that fluid flow is substantially unrestricted in one direction but is restricted by the tapering pin 124 entering the passageway 122 in the opposite direction. A light spring may be provided to retain the flexible flap valves 126 in closed position to preclude reverse flow through the passageways 128. Thus, in FIG. 12, pressure admitted to the passageway 120 from the conduit 64 will force the piston 114 to the right since the conduit 66 is in communication with the reservoir and fluid flow will continue to and through the holding valve 72 at the same time as it enters the cylinder 112 and as the piston 114 moves to the right, the tapering pin 124 entering the passageway 122 will restrict movement of the piston 114 so that the fluid flow entering the passageway 120 will then also enter the passageway 104 and communicate with the holding valve 88 thereby opening the holding valve 88 as pressure builds up and piston 114 closes off the passageway 122 which occurs just before the piston 114 strikes the piston head 118 thereby providing pressure flow into the conduits 46 and 48 as return flow is permitted by opening of the holding valve 88.

By moving the handle 80 on the valve 78, the fluid flow into conduit 82 may be blocked with the conduit 82 then being communicated with the bypass conduit 84 so that the piston and cylinder assembly 38 will become a single acting piston and conversely, the valve 94 may be manually operated in the same manner so that the piston and cylinder assembly 36 will become a single acting piston and cylinder assembly with the respective conduits 4 and 48 being communicated with the return conduit to the reservoir 52 thereby providing for quick return of the piston and cylinder assemblies 36 and 38 when in the single acting mode since the return fluid is not restricted by the holding valves respectively.

Figure 13:
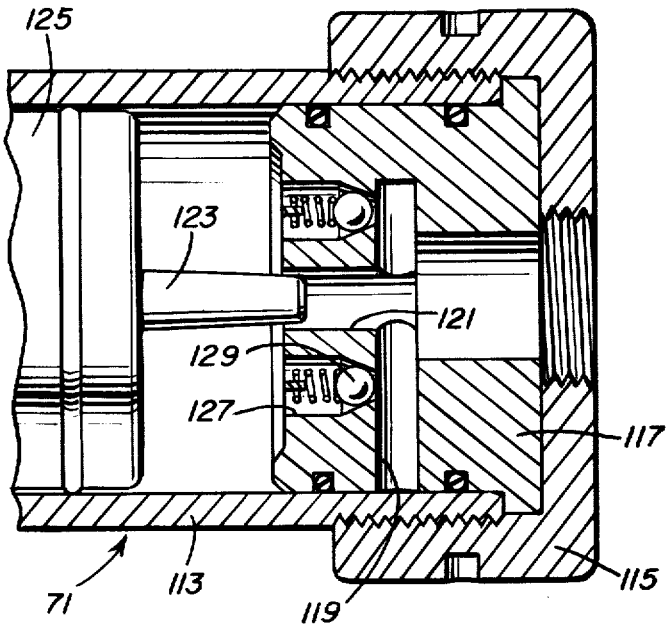
FIG. 13 is a fragmental sectional view of a somewhat simplified control piston and cylinder.
Figure 10:
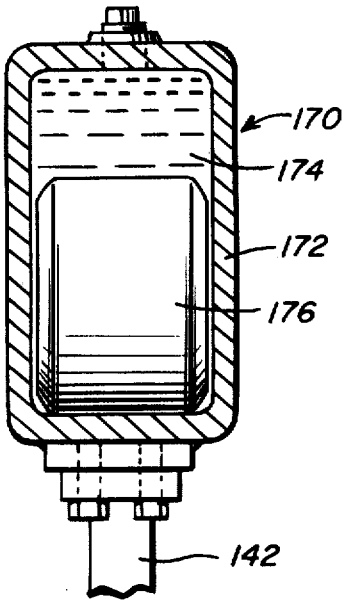
FIG. 10 is transverse sectional view taken substantially upon a plane passing along section line 10—10 of FIG. 4 illustrating further structural details of the oscillating weight including the fluid container and rolling weight therein.

FIG. 13 illustrates a simplified form of the control assembly 71 with each end of the cylinder 113 including a screw threaded cap 115 retaining a cylinder head 117 in place. The head 117 includes a transverse passageway 119 therein which communicates with longitudinal passageway 121 which has one end communicating with a hydraulic conduit and the other end receiving a tapered pin 123 on a piston 125. The head 117 also includes a pair of passageways 127 which are spaced from passageway 121 and include a spring biased check valve 129 therein. The passageway 119 also communicates with the cross over line extending to the holding valve in the opposite hydraulic conduit in the same manner as the device shown in FIG. 12.

The control arrangement 110 for the reversing valve 60 includes an actuating member 130 adjustably connected with the rod 108 with the actuating member being in the form of a strap having depending lugs 132 defining an open ended slot 134 along the lower edge thereof and a notch 136 is formed in the lower edge thereof adjacent the inner end. The rod 108 and the associated structure is retained within a housing 138 receiving a quantity of hydraulic fluid or the like. The notch 136 is engaged by a roller 140 on an oscillating arm 142 which pivots or oscillates about the pivot axis of shaft 186 so that as the arm 142 oscillates, the rod 108 which controls the reversing valve 60 will be reciprocated with the roller 140 having substantially less diameter than the length of the notch 136 to provide a lost motion connection between the arm 142 and the actuating member 130. The effective length of the rod 108 may be adjusted by screw threaded means to properly control the movement of the reversing valve and is pivotally connected to the spindle of valve 60 at 109. To disengage the actuating member 130 from the roller 140, the member 130 is provided with a longitudinal slot 144 movably connected with a pin 146 on the end of an eccentric 148 carried by a shaft 150 which has a corresponding offset arm 152, actuating rod 154 and handle 156 outwardly of the housing 138 so that the actuating member 130 may be manually disengaged from the roller 140 on the oscillating arm 142 by operating the handle 156. A similar offset arm 158 includes a roller 160 engaged in the slot 134 with the arm being connected to a hollow shaft 162 concentric with shaft 150 extending outwardly of the housing 138 and including an offset arm 164 thereon connected to a link or rod 166 connected to a handle 168 so that by manipulating the handles 156 and 168, the actuating member 130 may be disengaged from the roller 140 on the oscillating arm 142 and manually actuated thereby manually actuating the reversing valve and manually operating the hydraulic piston and cylinder assemblies.

The oscillating arm 142 includes a weight assembly generally designated by the numeral 170 on the upper end thereof which includes a container 172 having a quantity of oil or hydraulic fluid 174 therein and a rolling weight 176 of cylindrical configuration oriented therein for movement between the ends of the container 172 during oscillation of the weight assembly 170. A pair of oppositely disposed resilient bumpers or limit members 178 are mounted on the housing in an adjustable manner by virtue of a screw threaded connection 180 with a rigid tubular support structure 182 to provide limits for and cushions for the oscillating weight assembly 170. The lower end of the arm 142 is affixed to a spur gear 184 supported by shaft 186 with the shaft 186 including a sprocket gear 188 thereon receiving a sprocket chain 190 which is also entrained over a sprocket gear 192 mounted on a shaft 194 which extends out through the housing 138 and includes an assembly 196 connecting shaft 194 to an operating rod 198 connected to the beam 26 through a release clutch mechanism 200 so that as the beam 26 oscillates, the shaft 194 will be oscillated through the connection 196 thereby oscillating the shaft 186 through the chain and sprocket drive and oscillating the weight assembly 170 due to its rigid connection with the gear 184 through the arm 142 with this oscillation causing reciprocation of the actuating member 130 and the control rod 108 to the reversing valve 60. The connection 196 with the operating rod 198 includes an offset arm 202 connected to a bracket structure 204 rockable on the shaft 194 and having lugs 206 thereon with adjustable stops 208 therein in the form of threaded bolts engaging a projecting lug 210 on a sleeve 212 rigid with the shaft 194 so that there is a lost motion connection between the rod 198 and the shaft 194 with this lost motion connection being adjustable by varying the adjustment abutments 208. This arrangement enables the beam 26 to pivot the weight assembly 170 to a point above an equilibrium point so that the weight assembly will then move by gravity toward one of the bumpers 178 in one direction of the movement of the beam 26 with the rolling weight 176 being utilized to assure a shifting of the center of gravity of the weight assembly 170 to a point beyond the top dead center of the weight assembly 170 and to provide sufficient force to move the actuating member 130 to operate the reversing valve.

Figure 4:
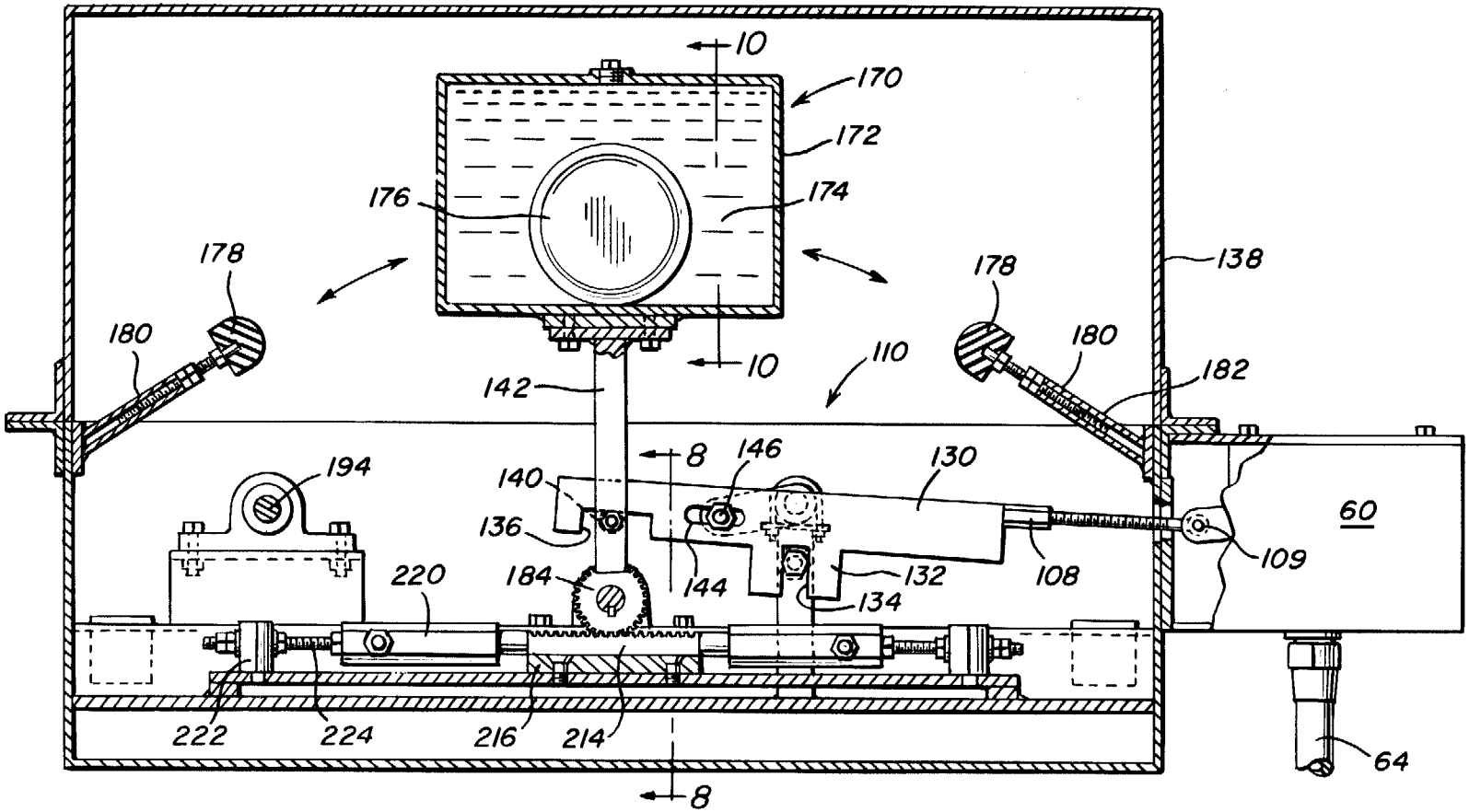
FIG. 4 is a vertical sectional view, on an enlarged scale, illustrating the control arrangement for the reversing valve.
Figure 6:
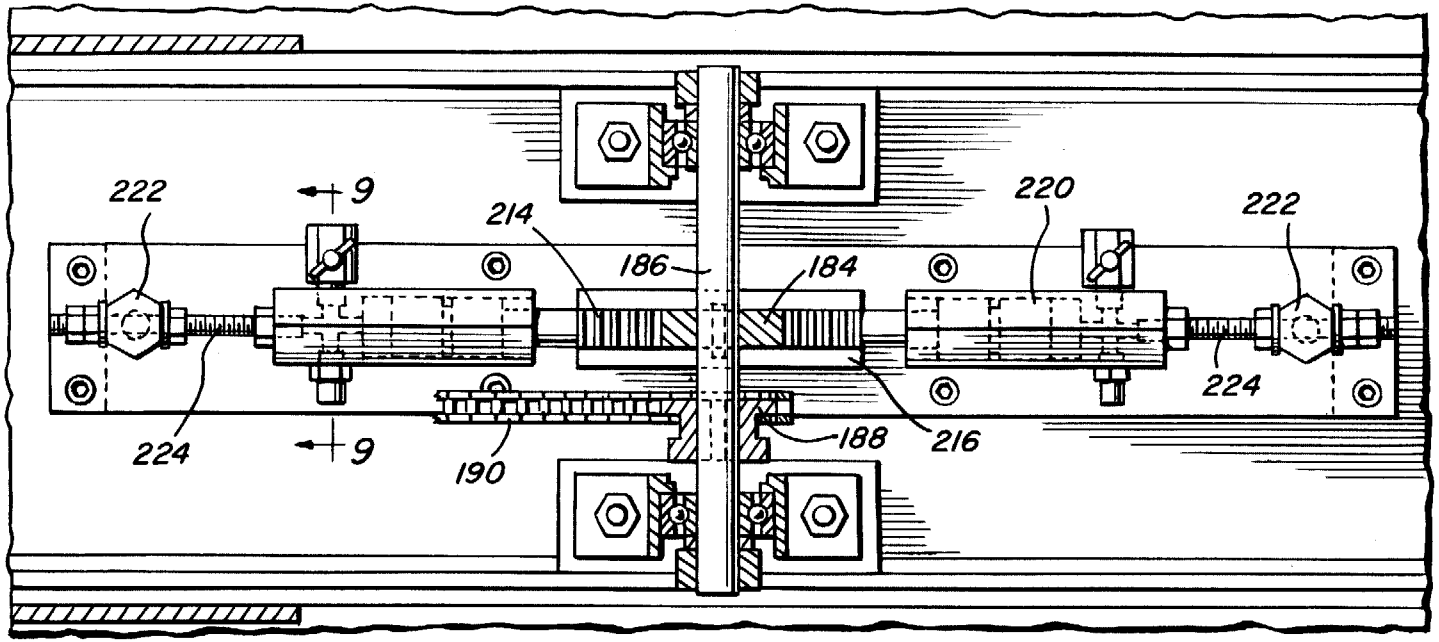
FIG. 6 is a plan sectional view taken at a lower elevation than FIG. 5.
Figure 7:
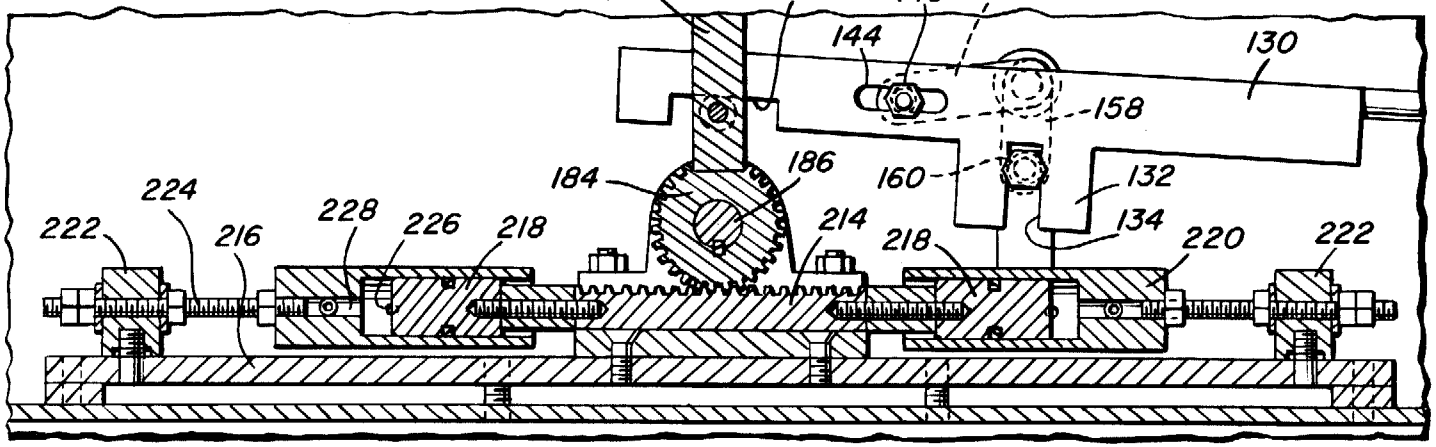
FIG. 7 is a longitudinal sectional view, on an enlarged scale, illustrating the construction of the control piston and cylinder assembly for the reversing valve.

Movement of the weight assembly 170 is controlled by an elongated rack gear 214 underlying and meshing with the gear 184 and supported on a slide 216. As illustrated in FIG. 7, each end of the rack gear 214 is provided with a piston 218 received in a cylinder 220 with the structure being identical at both ends of the rack gear 214. The cylinder 220 is adjustably supported from a bracket structure 222 by a screw threaded mechanism 224 so that the cylinder 220 is in alignment with and receives the reciprocating piston 218. The cylinder 220 is provided with an inlet aperture 226 in the side wall thereof and at the end thereof the cylinder is provided with a longitudinal passageway 228 formed in a fitting 230 having a inlet check valve 232 and an outlet passageway 234 controlled by a manual valve 236 having a passageway or orifice 238 therein which can be set to control discharge of fluid from the cylinder 220 after the piston 218 has been moved to a position to close off the aperture 226 (See FIG. 9). During reciprocation of the piston 218, fluid which covers the entire apparatus can be pulled in through the check valve 232 and into the opening 226 after the piston moves outwardly beyond the opening 226. As the piston 218 moves back into the cylinder 220, fluid in the cylinder will flow freely out through the aperture 226 until the piston 218 closes off the aperture 226 after which the fluid trapped in the cylinder 220 must then exit through the orifice 238 which is adjusted to provide a controlled rate of movement of the piston 218 thereby controlling the rate of movement of the gear 184 and correspondingly controlling the rate of movement of the actuating member 130. Appropriate supporting bearings, flanges, and the like, are provided for the components of the control assembly for the reversing valve with the entire housing being partially filled with hydraulic fluid to a level at least above the rack gear and the corresponding pistons and cylinders for controlling movement of the weight. The oscillating weight assembly 170 also is normally enclosed within a top removable housing component as illustrated in FIG. 4 to preclude unauthorized tampering with the control arrangement 110 with the handles 156 and 168 also being provided with lock devices, if desired, since the pump jack will be located at remote locations so that the entire assembly is maintained in a secure manner.

The base or skid structure may be provided with an adjustable end 23 by which variations in terrain may be accommodated and additional support may be provided by extending the length of the skid as desired.

Figure 14:
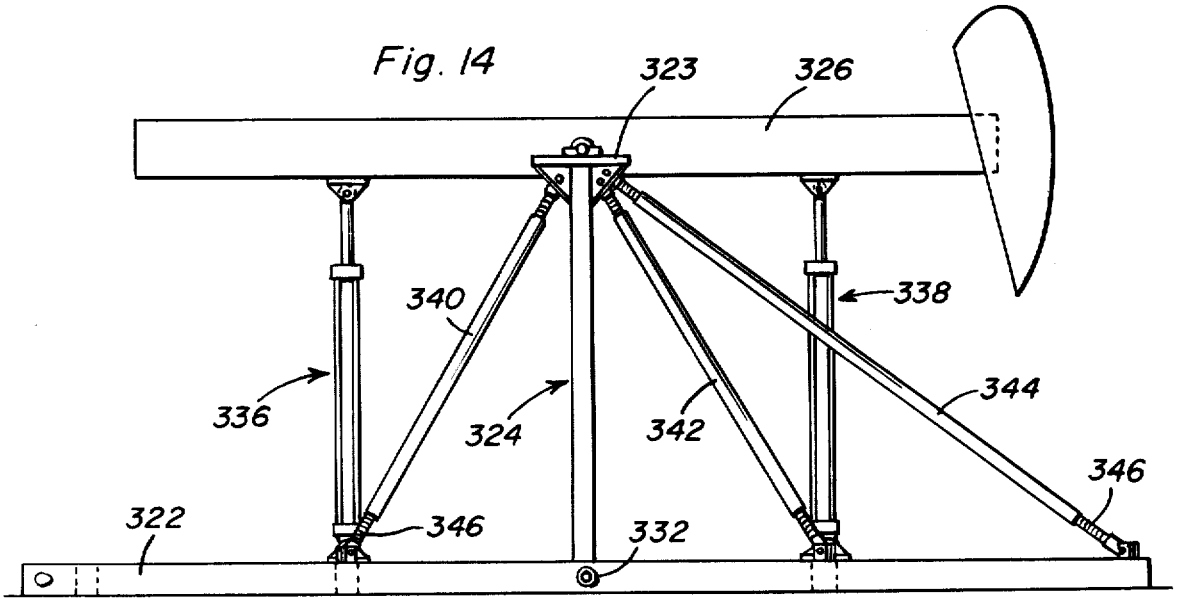
FIG. 14 is a side elevational view illustrating schematically another form of the supporting structure for the pump jack of the present invention.
Figure 15:
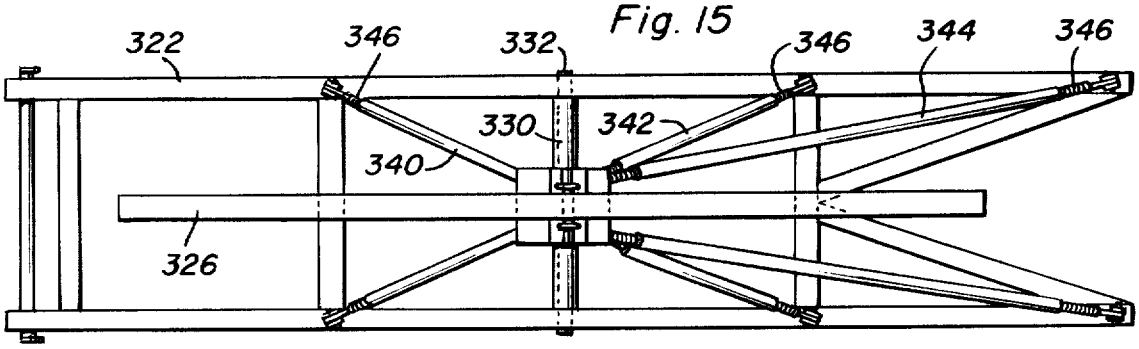
FIG. 15 is a plan view of the construction of FIG. 13.

FIGS. 14 and 15 illustrate a modification of the supporting structure in which a skid 322 is provided to support the beam 326 with piston and cylinder assemblies 336 and 338 used to oscillate the beam 326 in the same manner as in FIG. 1, but in this construction, a supporting post assembly 324 is provided which is pivotally connected to the skid 322 by a pipe or sleeve 330 extending between the rails of the skid 322 and receiving a rod or pipe 332 therethrough so that the supporting post assembly 324 may be folded downwardly to facilitate transportation of the pump jack to a well site and also to facilitate assembly and disassembly of the components. A plurality of braces 340, 342 and 344 extend from the attaching bracket 328 to the skid 322 to support the post assembly 324 in its upright position with the upper and lower ends of each of the braces being provided with a screw threaded adjustment connection 346 to provide for variation in the position of the skids and provide for wider distribution of forces to the skid 322 to provide for longer life expectancy of the structural components since the forces produced by the oscillating beam would be distributed substantially throughout the length of the skid rather than being concentrated at the central area thereof as in the structure of FIG. 1.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a pump jack having a beam supported for pivotal movement about a generally horizontal transverse axis and means at one end of said beam for connection with a pump rod, a pair of hydraulic fluid pressure operated piston and cylinder assemblies connected to said beam for powering the beam about its pivot axis, each of said piston and cylinder assemblies being powered from a hydraulic pump having a separate conduit connected to each end of the cylinders, a reversing valve communicating the pump with the conduits, means interconnecting the reversing valve and the beam for controlling the position of the reversing valve in response to movement of the beam, and means controlling flow in each of the conduits between the reversing valve and the piston and cylinder assemblies for providing positive control of the movement of the beam throughout its cycle of movement, said flow control means including valve means in each conduit enabling flow toward the piston and cylinder assemblies and preventing return flow, and means responsive to flow in one conduit toward the piston and cylinder assembly to open the valve means in the other conduit to enable return flow.

2. The structure as defined in claim 1 wherein each of said valve means in the conduits between the reversing valve and piston and cylinder assemblies being one-way valves and hydraulically operated to open the one-way valve to enable return flow, said means responsive to flow in one conduit to open the valve means in the other conduit including a piston and cylinder assembly communicating with both of the conduits and including a flow line from said one conduit to the valve means in the other conduit for opening the valve means in the other conduit upon flow in said one conduit.

3. The structure as defined in claim 2 wherein said piston and cylinder assembly interconnecting the conduits includes a cylinder having its opposite ends communicated with the conduits, a free moving piston in the cylinder, whereby flow in said one conduit will move the piston toward the other conduit when the other conduit is communicated for return flow to the hydraulic pump through the reversing valve, thereby providing a delay in opening the valve means in the other conduit until after initial flow in said one conduit.

4. The structure as defined in claim 3 wherein said delay is provided by movement of the free piston in the cylinder, said piston and cylinder being duplicative at each end with each side of the piston including a tapering pin received in a passageway in the end of the cylinder to enable free movement of the piston away from said one conduit when flow commences therein and restricted flow as the tapering pin enters the passageway to stop the free piston before it contacts the end of the cylinder with flow then going to the valve means in the other conduit for opening that valve means to enable return flow.

5. The structure as defined in claim 4 wherein each end of the cylinder is provided with inlet valve means enabling unrestricted flow into the cylinder from the conduit with which it is communicated in one direction, but preventing flow outwardly therefrom, thus requiring that such flow be through a passageway receiving the tapering pin.

6. The structure as defined in claim 5 together with a manual valve in each of the conduits between the valve means and the piston and cylinder assemblies to enable conversion of either or both of the piston and cylinder assemblies between single acting and double acting modes.

7. The structure as defined in claim 1 together with a manual valve in each of the conduits between the valve means and the piston and cylinder assemblies to enable conversion of either or both of the piston and cylinder assemblies between single acting and double acting modes.

8. The structure as defined in claim 1 wherein said means interconnecting the reversing valve and the beam includes an actuating member connected to the reversing valve, a linkage mechanism connected with the beam, an oscillating weight assembly interconnecting the linkage mechanism and actuating member.

9. The structure as defined in claim 8 wherein said oscillating weight assembly includes a fluid tank and a depending support arm, a quantity of fluid in the tank and a rolling weight in the tank to carry the weight assembly to its extreme positions over top dead center.

10. The structure as defined in claim 9 wherein the depending arm on the oscillating weight assembly includes a spur gear rigid therewith, a roller on said arm, said actuating member including a notch engaged with the roller, said actuating member being vertically liftable to disengage the notch from the roller to enable manual actuation of the actuating member independent of the oscillating weight assembly, and a rack gear engaged with the gear on the lower end of the arm for reciprocation in response to oscillation of the weight, and fluid pressure operated control means for controlling reciprocation of the rack gear.

11. The structure as defined in claim 10 together with a manual control means connected to the actuating member for the reversing valve with the manual control means being operative when the actuating member is disengaged from the roller on the supporting arm for the oscillating weight assembly.

12. The structure as defined in claim 11 wherein said means controlling reciprocation of said rack gear includes a piston on each end thereof, a cylinder receiving each of the pistons, each of the cylinders including an unrestricted inlet and a manually controlled outlet orifice at the inner end of the cylinder and an aperture uncovered by the piston during reciprocation to enable free inlet and outlet during a portion of the reciprocation of the piston within the cylinder thereby enabling free movement of the oscillating weight assembly during a portion of its movement, but controlled movement during the end portions of its oscillation.

13. The structure as defined in claim 12 wherein each of said valve means in the conduits between the reversing valve and piston and cylinder assemblies being one-way valves and hydraulically operated to open the one-way valve to enable return flow, said means responsive to flow in one conduit to open the valve means in the other conduit including a piston and cylinder assembly communicating with both of the conduits and including a flow line from said one conduit to the valve means in the other conduit for opening the valve means in the other conduit upon flow in said one conduit.

14. The structure as defined in claim 2 wherein said means interconnecting the reversing valve and the beam includes an actuating member connected to the reversing valve, a linkage mechanism connected with the beam, and oscillating weight assembly interconnecting the linkage mechanism and actuating member.

* * * * *